US012345126B2

(12) United States Patent
Cuffe et al.

(10) Patent No.: US 12,345,126 B2
(45) Date of Patent: Jul. 1, 2025

(54) VALVE ASSEMBLY FOR INFLATABLE PACKERS

(71) Applicant: INNOVEX DOWNHOLE SOLUTIONS, INC., Humble, TX (US)

(72) Inventors: Chris Cuffe, The Woodlands, TX (US); Bennett Griffith, Houston, TX (US)

(73) Assignee: INNOVEX DOWNHOLE SOLUTIONS, INC., Humble, TX (US)

( * ) Notice: Subject to any disclaimer, the term of this patent is extended or adjusted under 35 U.S.C. 154(b) by 65 days.

(21) Appl. No.: 18/449,804

(22) Filed: Aug. 15, 2023

(65) Prior Publication Data

US 2024/0060392 A1 Feb. 22, 2024

Related U.S. Application Data

(60) Provisional application No. 63/371,775, filed on Aug. 18, 2022.

(51) Int. Cl.
*E21B 34/10* (2006.01)
*E21B 33/127* (2006.01)

(52) U.S. Cl.
CPC ..... *E21B 34/102* (2013.01); *E21B 33/127* (2013.01)

(58) Field of Classification Search
CPC ..... E21B 33/127; E21B 34/102
See application file for complete search history.

(56) References Cited

U.S. PATENT DOCUMENTS 10,619,447 B2 4/2020 Kelley et al.
11,203,915 B2 12/2021 Kelley et al.
2020/0199969 A1* 6/2020 Kelley ..... E21B 34/10

* cited by examiner

*Primary Examiner* — Kristyn A Hall
(74) *Attorney, Agent, or Firm* — MH2 Technology Law Group, LLP

(57) ABSTRACT

A valve assembly for an inflatable packer includes an opening valve configured to actuate into an open position in response to a first pressure within a tubular string, so as to permit fluid flow from the tubular string, through the valve assembly, and into an inflatable packer element. The valve assembly also includes a closing valve configured to actuate into a closed position so as to prevent fluid flow from the tubular string, through the valve assembly, and into the inflatable packer element in response to a second pressure within the inflatable packer element. The valve assembly also includes a contingency valve configured to actuate into a closed position so as to prevent fluid flow from the tubular string, through the valve assembly, and into the inflatable packer element in response to a third pressure in the tubular string.

21 Claims, 7 Drawing Sheets

VALVE ASSEMBLY FOR INFLATABLE PACKERS

CROSS-REFERENCE TO RELATED APPLICATIONS

This application claims priority to U.S. Provisional Patent Application No. 63/371,775, filed on Aug. 18, 2022, which is incorporated by reference herein.

BACKGROUND

Tools are run into wellbores in the oil and gas industry to accomplish a variety of different tasks. One type of tool is a packer, which may be run into the well as part of a string of tubulars (e.g., a casing string). Upon reaching a desired position in the well, the packer may be expanded to engage and seal with the well, thereby blocking the annulus between the tubular string and the well at a desired position.

Inflatable packers are one such type of packer. The inflatable packers are typically run into the well and then expanded by forcing fluid from within the string into a contained volume radially between an inflatable element and a mandrel or another tubular. The inflatable element may be pressed radially outward by the continuing application of pressure, and thereby expand outward and block the annulus. Generally, the inflation process is controlled by pressure in the string and in the inflatable element, along with a valve assembly. The pressure may initially be increased above a threshold, which may open an "opening" valve, permitting fluid to be delivered to the inflatable element to commence inflation. The pressure in the inflatable element may eventually reach a level that indicates it has fully expanded, which may trigger a "closing" valve to close, so as to prevent further fluid flow into the inflatable element and lock the fluid within the inflated inflatable element.

Occasionally, the inflatable element may fail, e.g., rupture, such that fluid fed to the inflatable member flows into the wellbore. When this happens, the pressure rise in the inflatable element may not be experienced, and thus the closing valve may not close. Accordingly, fluid flow through the tubular string may be permitted to flow out into the wellbore through the ruptured inflatable element in an uncontrolled manner.

SUMMARY

A valve assembly for an inflatable packer includes an opening valve configured to actuate into an open position in response to a first pressure within a tubular string, so as to permit fluid flow from the tubular string, through the valve assembly, and into an inflatable packer element. The valve assembly also includes a closing valve configured to actuate into a closed position so as to prevent fluid flow from the tubular string, through the valve assembly, and into the inflatable packer element in response to a second pressure within the inflatable packer element. The valve assembly also includes a contingency valve configured to actuate into a closed position so as to prevent fluid flow from the tubular string, through the valve assembly, and into the inflatable packer element in response to a third pressure in the tubular string.

An inflatable packer is also disclosed. The inflatable packer includes an inflatable packer element fluidly connected to a tubular string. The inflatable packer also includes a valve assembly coupled to and positioned between the tubular string and the inflatable packer element. The valve assembly includes an opening valve, a closing valve, and a contingency valve. The valve assembly includes a plurality of configurations including a run-in configuration in which the opening valve is in a closed position, the closing valve is in an open position, and the contingency valve is in an open position. The configurations also include an inflation configuration. The valve assembly is configured to actuate from the run-in configuration to the inflation configuration in response to a first pressure within the tubular string. In the inflation configuration, the opening valve is in an open position to permit fluid flow from the tubular string, through the valve assembly, and into the inflatable packer element, and the closing and contingency valves remain in the respective open positions. The configurations also include a first closed configuration. The valve assembly is configured to actuate from the inflation configuration to the first closed configuration in response to a second pressure in the inflatable packer element. In the first closed configuration, the closing valve is in a closed position to prevent fluid flow from the tubular string, through the valve assembly, and into the inflatable packer element, and the open and contingency valves remain in the respective open positions. The configurations also include a contingency configuration in response to the second pressure not being reached. The valve assembly is configured to actuate from the inflation configuration to the contingency configuration in response to a third pressure in the tubular string. In the contingency configuration, the contingency valve is in a closed position to prevent fluid flow from the tubular string, through the valve assembly, and into the inflatable packer element, and the opening and closing valves remain in the respective open positions. The third pressure is greater than the first pressure and independent of a pressure in the inflatable packer element.

A method for operating an inflatable packer includes deploying a valve assembly into a wellbore in a run-in configuration. The valve assembly includes an opening valve, a closing valve, and a contingency valve. In the run-in configuration, the opening valve is in a closed position, the closing valve is in an open position, and the contingency valve is in an open position. The method also includes increasing a pressure within a tubular string to a first pressure level, which actuates the valve assembly from the run-in configuration into an inflation configuration. The opening valve drives into an open position when actuating into the inflation configuration so as to permit fluid flow from the tubular string, through the valve assembly, and into an inflatable packer element, while the closing and contingency valves remain in the respective open positions. The method also includes increasing a pressure within the tubular string to a third pressure level in response to not being able to reach a second pressure level in the inflatable packer element. Increasing the pressure within the tubular string to the third pressure level actuates the valve assembly from the run-in configuration into a contingency configuration. The contingency valve drives into a closed position when actuating into the contingency configuration to prevent fluid flow from the tubular string, through the valve assembly, and into the inflatable packer element, while the opening and closing valves remain in the respective open positions.

BRIEF DESCRIPTION OF THE DRAWINGS

The present disclosure may best be understood by referring to the following description and accompanying drawings that are used to illustrate some embodiments. In the drawings.

DETAILED DESCRIPTION

Figure 1:
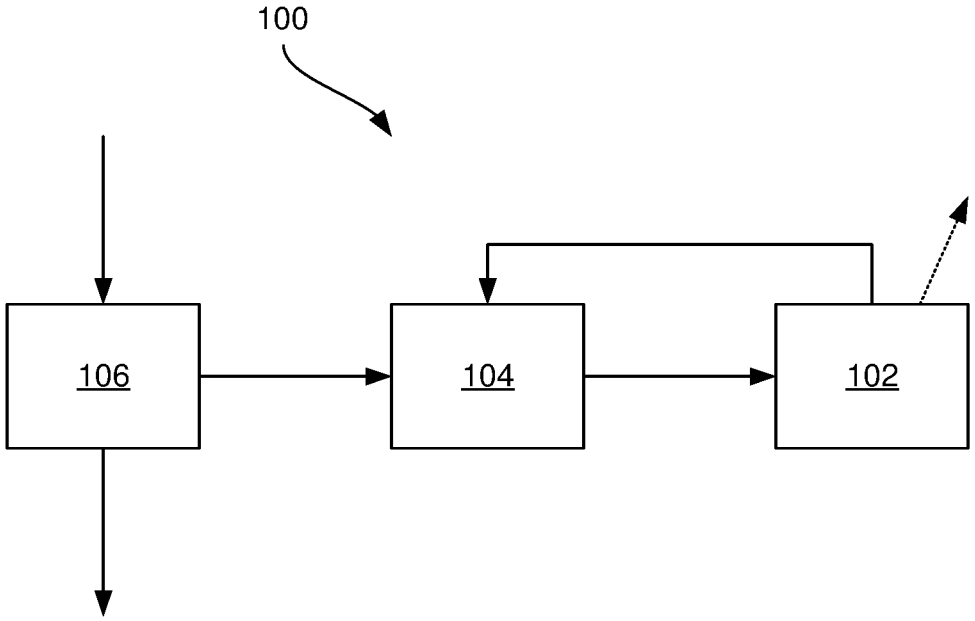
FIG. 1 illustrates a block diagram of fluid flow in an inflatable packer, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

FIG. 1 illustrates a block diagram of fluid flow in an inflatable packer 100, according to an embodiment. As shown, the packer 100 may include an inflatable packer element (or "inflatable element") 102 and a valve assembly 104, with the inflatable element 102 being fluidly connected to a tubular string 106 (e.g., casing string) via the valve assembly 104. The valve assembly 104 may thus control fluid flow to the inflatable element 102. As will be described in greater detail below, the valve assembly 104 may initially be in a run-in configuration, in which fluid from the tubular string 106 is blocked from reaching the inflatable element 102, thereby retaining the inflatable element 102 uninflated for deployment into the wellbore. Fluid that is fed through the tubular string 106 to the valve assembly 104 may eventually reach a first pressure (or "pressure level"), thereby actuating the valve assembly 104 from the run-in configuration to an inflation configuration. In the inflation configuration, the valve assembly 104 permits fluid from the tubular string 106 to reach the inflatable element 102 and inflate the inflatable element 102.

In at least some embodiments, pressure within the inflatable element 102 may rise during the inflation operation until it reaches a second pressure (pressure level), which may represent that the inflatable element 102 has fully inflated. This second pressure may be communicated back to the valve assembly 104, which may, in response, actuate to a closed configuration, in which fluid is again blocked from proceeding from the tubular string 106 to the inflatable element 102. The value of the second pressure may be the same, less than, or equal to the value of the first pressure.

In at least some embodiments, the second pressure may not be reached, e.g., because the inflatable element 102 (or some other part of the inflatable packer 100) has failed (e.g., ruptured). For example, as indicated by the dashed arrow, fluid may escape from within the inflatable element 102 and into the surrounding wellbore annulus, thereby preventing the pressure rise that cause the valve assembly 104 to actuate from the inflation configuration to the closed configuration. Accordingly, a third pressure may be applied via fluid in the tubular string 106 to the valve assembly 104, which may be independent of the pressure in the inflatable element 102 and may be higher than the first pressure. Upon reaching the third pressure (pressure level), the valve assembly 104 may actuate to a contingency configuration, in which a contingency valve is closed, thereby blocking fluid flow from the tubular string 106 to the inflatable element 102, despite the pressure in the inflatable element 102 not reaching the second pressure. The value of the third pressure may be greater than the value of the first pressure and/or independent of the pressure in the inflatable element 102.

Figure 2:
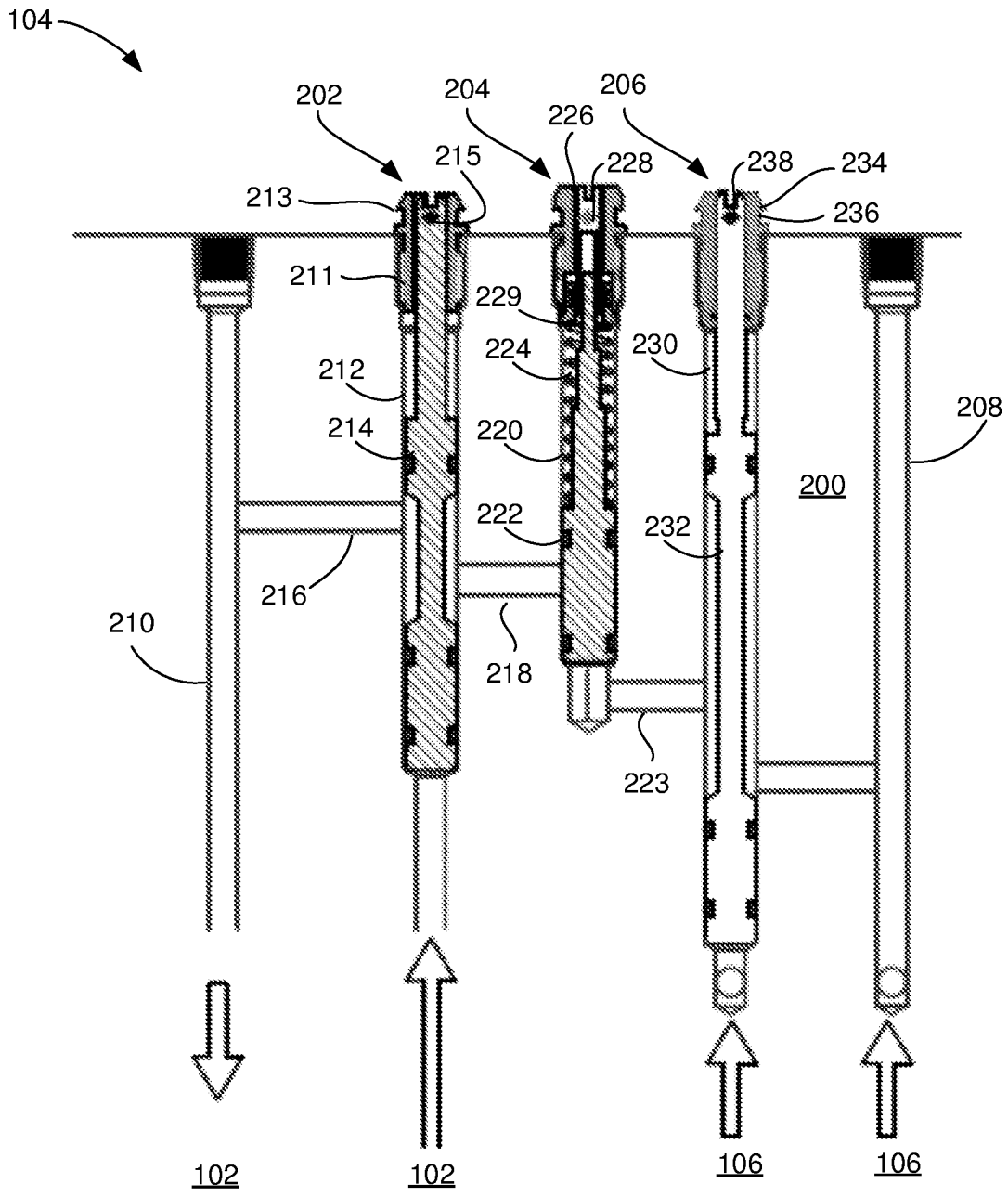
FIG. 2 illustrates a schematic view of a valve assembly in the inflatable packer in a run-in configuration, according to an embodiment.

FIG. 2 illustrates a cross-sectional view of the valve assembly 104 in the run-in configuration, according to an embodiment. The valve assembly 104 may include a valve housing 200, in which the various flowpaths described hereinbelow may be defined (e.g., as conduits, cutouts, tubes/tubing, etc.). The valve assembly 104 may generally include a closing valve 202, an opening valve 204, and a contingency valve 206, which may be located at least partially within the valve housing 200. Further, the valve assembly 104 may include an inlet 208 that is connected to the interior of the tubular string 106 (FIG. 1) and an outlet 210 that is connected to the inflatable element 102 (FIG. 1).

The closing valve 202 may include a closing valve cylinder 212, defined in the valve housing 200, and a closing valve member 214. The closing valve member 214 may be movable in the closing valve cylinder 212 between an open position, as illustrated, and a closed position (e.g., shifted upwards from the view shown in FIG. 2). For example, the bottom (in this view) of the closing valve cylinder 212 may be in communication with the inflatable element 102 (FIG.

1), such that pressure within the inflatable element 102 acts upon the closing valve member 214 and tends to push the closing valve member 214 upwards.

The closing valve 202 may further include a restraint 213, which may, at least initially, prevent the closing valve member 214 from moving upward. The restraint 213 may include a body 211 and a shearable member 215. The body 211 may be received at least partially into the closing valve cylinder 212, and may, for example, be threaded or otherwise retained therein. The shearable member 215 may be coupled to or otherwise engage the closing valve member 214, so as to prevent displacement of the closing valve member 214 at least in the upward direction, through the body 211. The shearable member 215 may be any type of member that is configured to break or otherwise yield, in response to the pressure in the inflatable element 102 acting on the closing valve member 214 (e.g., at second pressure level), as discussed above. Once the shearable member 215 yields, the closing valve member 214 may be free to slide upwards, until an enlarged section thereof abuts the body 211.

Additionally, an outlet conduit 216 and a first intermediate conduit 218 may extend from the closing valve cylinder 212 in opposite lateral directions. In the open position of the closing valve member 214 (and thus of the closing valve 202), as illustrated, fluid flow is permitted between the first intermediate conduit 218 and the outlet conduit 216 via the closing valve cylinder 212 (around the narrow section of the closing valve member 214).

The opening valve 204, which may be positioned immediately adjacent to the closing valve 202, may include an opening valve cylinder 220 and an opening valve member 222. The first intermediate conduit 218 may extend from the opening valve cylinder 220. A second intermediate conduit 223 may extend from the opening valve cylinder 220 in an opposite lateral direction as the first intermediate conduit 218. The opening valve member 222 has an open position that permits fluid flow between the first and second intermediate conduits 218, 223, and a closed position (illustrated) that prevents such fluid flow.

Further, the opening valve member 222 may be biased toward the bottom (in this view) of the opening valve cylinder 220 (e.g., toward the closed position) by a biasing member 224 (e.g., a spring). The opening valve 204 may also include a restraint 226, which may include a shearable member 228 that initially holds the opening valve member 222 in a closed position, near the bottom. The restraint 226 may be received at least partially into and (e.g., threaded in engagement with) the valve housing 200, particularly, at least partially in the opening valve cylinder 220. Pressure in the tubular string 106 reaching the first pressure level may act on the opening valve member 222, yielding the shearable member 228, such that the opening valve member 222 is permitted to travel upwards, at least partially through the restraint 228, to the open position. The restraint 226 may also include a lock 229, which may engage the opening valve cylinder 220, after it has stroked down to the closed position, and prevent it from returning to the open position.

The contingency valve 206 may include a contingency valve cylinder 230 formed in the valve housing 200 and a contingency valve member 232. The contingency valve 206 may be immediate adjacent to the opening valve 204, such that the opening valve 204 is positioned between the contingency valve 206 and the closing valve 202. Further, the second intermediate conduit 223 may extend from the contingency valve cylinder 230, and the contingency valve cylinder 230 may be in communication with the inlet 208. Additionally, the bottom of the contingency valve cylinder 230 may be in communication with the interior of the tubular string 106 (FIG. 1), such that pressure in the tubular string 106 acts on the contingency valve member 232. The contingency valve member 232 (and thus the contingency valve 206) may have an open position, as illustrated, which may permit fluid flow between the inlet 208 and the second intermediate conduit 223, and a closed position that blocks such fluid flow, and thus prevents fluid flow to both the opening valve 204 and the closing valve 202, regardless of the position of either of these two valves 202, 204.

The contingency valve 206 may include a restraint 234, which may be received at least partially in the contingency valve cylinder 230 and (e.g., threaded into connection with) the valve housing 200. The restraint 234 may include a body 236 and a shearable member 238. The contingency valve member 232 may be received at least partially through the body 236 and may be coupled to the shearable member 238. At least initially, the shearable member 238 may restrain the contingency valve member 232 in an open position, as shown. The pressure in the tubular string 106 reaching the third pressure level, as noted above, may act on the contingency valve member 232, such that the shearable member 238 yields and permits the contingency valve member 232 to stroke upwards into a closed position. The body 236 may be threaded into connection with the contingency valve cylinder 230.

Figure 3:
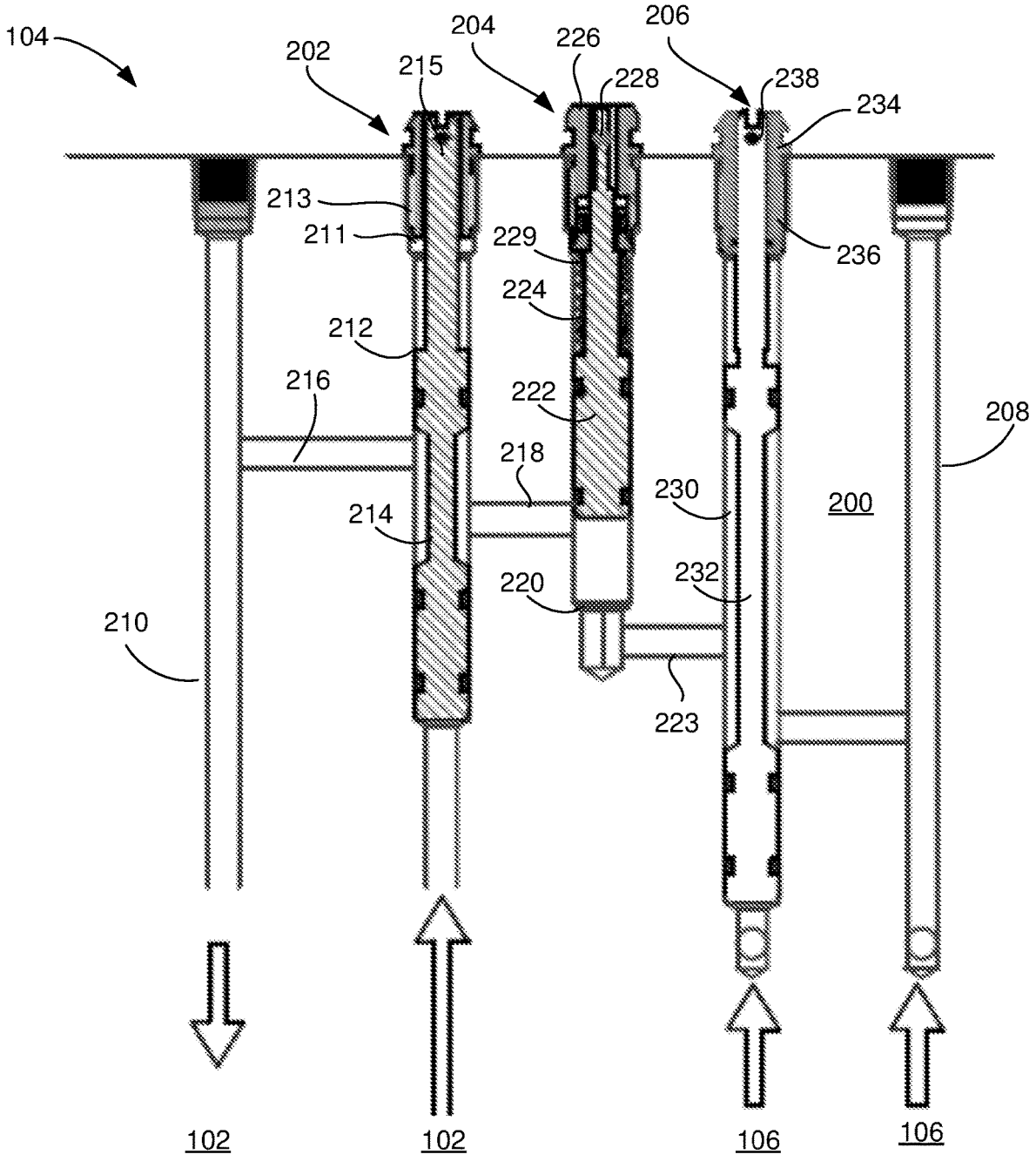
FIG. 3 illustrates a schematic view of the valve assembly in an inflation configuration, according to an embodiment.

FIG. 3 illustrates a schematic view of the valve assembly 104 in the inflation configuration, according to an embodiment. As shown, fluid pressure in the tubular string 106 is communicated through the contingency valve 206 and into the opening valve 204 via the second intermediate conduit 223. Once the pressure reaches the first pressure, the restraint 226 releases (e.g., the shearable member 228 yields), and the pressure in the inlet 208 acting on the opening valve member 222 overcomes the biasing force and moves to the open position, permitted the fluid to flow through the first intermediate conduit 218 and into the closing valve 202. The closing valve 202 is restrained in the open position, and thus fluid flows therethrough to the outlet 210 and into the inflatable element 102 (FIG. 1).

Eventually, the inflatable element 102, if it does not rupture, may experience a pressure rise as it continues to inflate and engages the surrounding tubular (e.g., wellbore). The pressure in the inflatable element 102 is communicated back to the valve assembly 104, as noted above, and specifically to the closing valve 202 (e.g., the bottom of the closing valve cylinder 212). The pressure in the inflatable element 102 is thus communicated to the closing valve member 214, and, upon reaching the second pressure, causes the restraint 213 to release (e.g., the shearable member 215 yields) the closing valve member 214.

Figure 4:
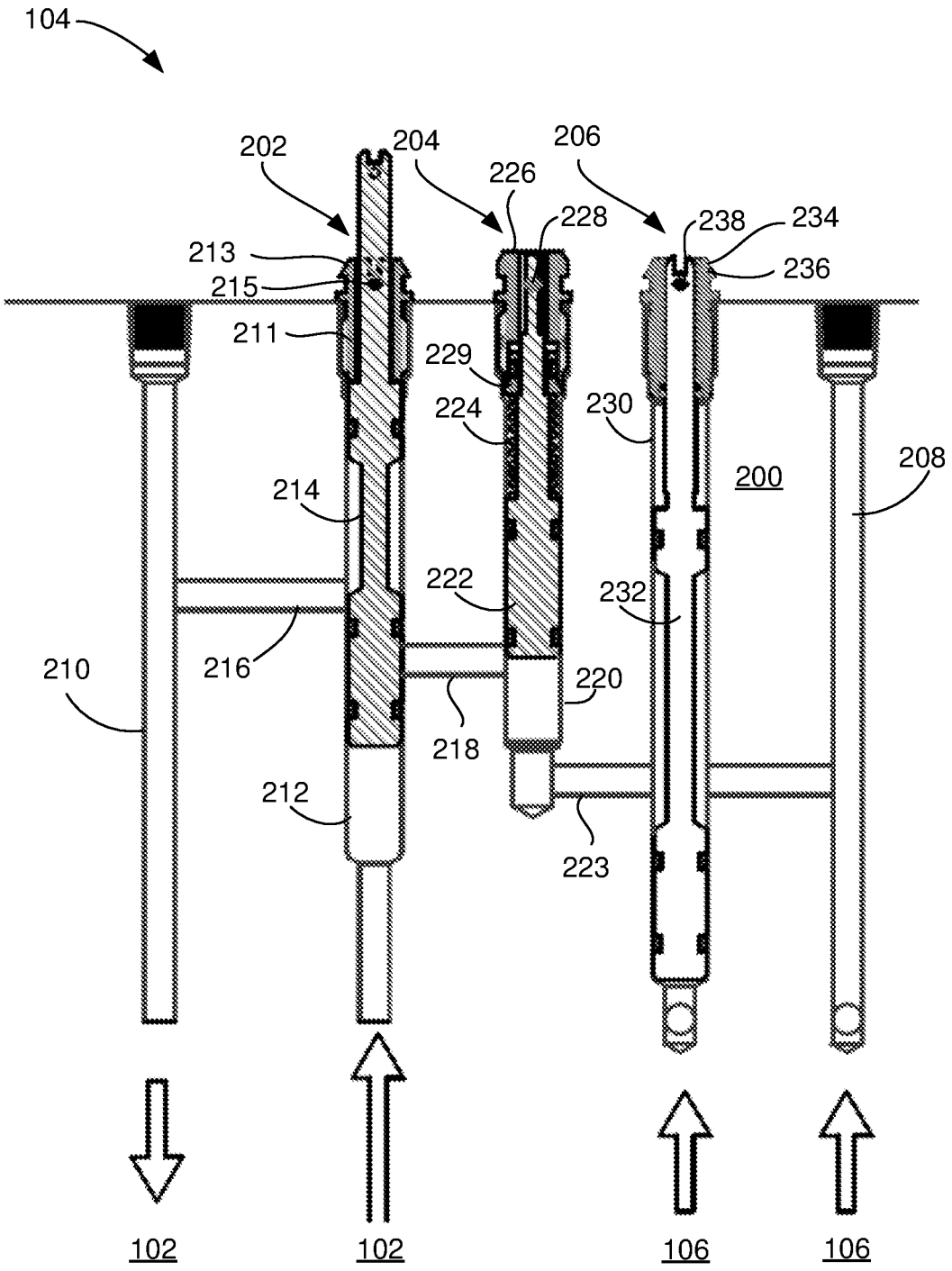
FIG. 4 illustrates a schematic view of the valve assembly in a first closed configuration, according to an embodiment.
Figure 5:
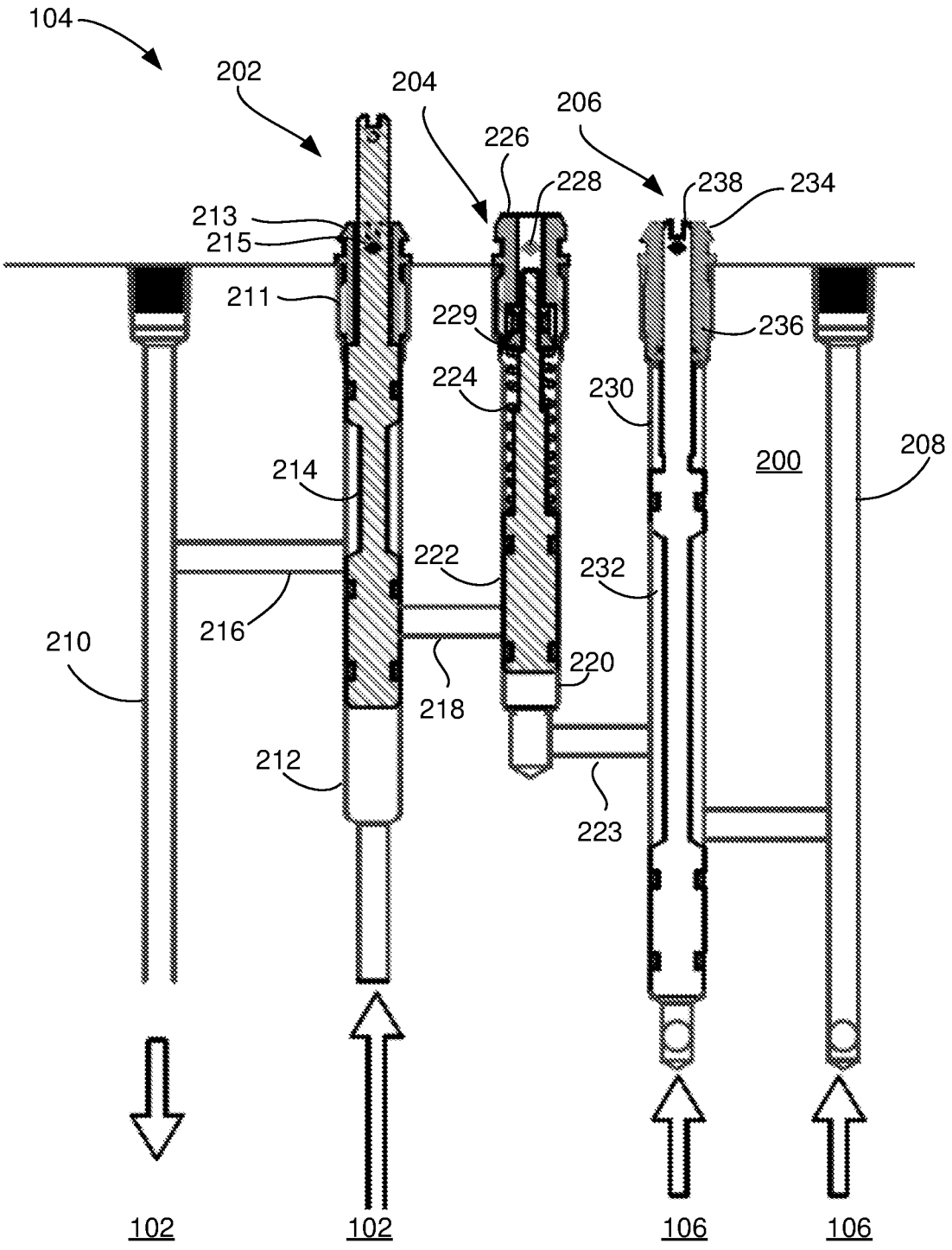
FIG. 5 illustrates a schematic view of the valve assembly in a second closed configuration, according to an embodiment.

Proceeding to FIG. 4, the closing valve member 214 may stroke upwards in response to the elevated pressure in the inflatable element 102 (FIG. 1) and move to the closed position. In this stage, fluid flow from the inlet 208 to the outlet 210 is blocked by the closing valve 202. As shown in FIG. 5, pressure in the tubular string 106 (FIG. 1) may reduce, and the biasing member 224 of the opening valve 204 may force the opening valve member 214 into the closed position, thereby actuating the valve assembly 104 into a second closed configuration. The lock 229 of the opening valve 204 may then engage, preventing the opening valve 204 from returning to an open position.

In some cases, pressure in the inflatable element 102 (FIG. 1) may not reach the second pressure level. For example, as discussed above, the inflatable element 102 may rupture. This may, additionally, allow for fluid flow from the tubular string 106 (FIG. 1) via the inlet 208 to prevent the opening valve 204 from stroking downward to the closed position, and thus the fluid flow in the tubular string 106 may flow generally uncontrolled through the valve assembly 104 and into the wellbore annulus via the ruptured inflatable element 102.

Figure 6:
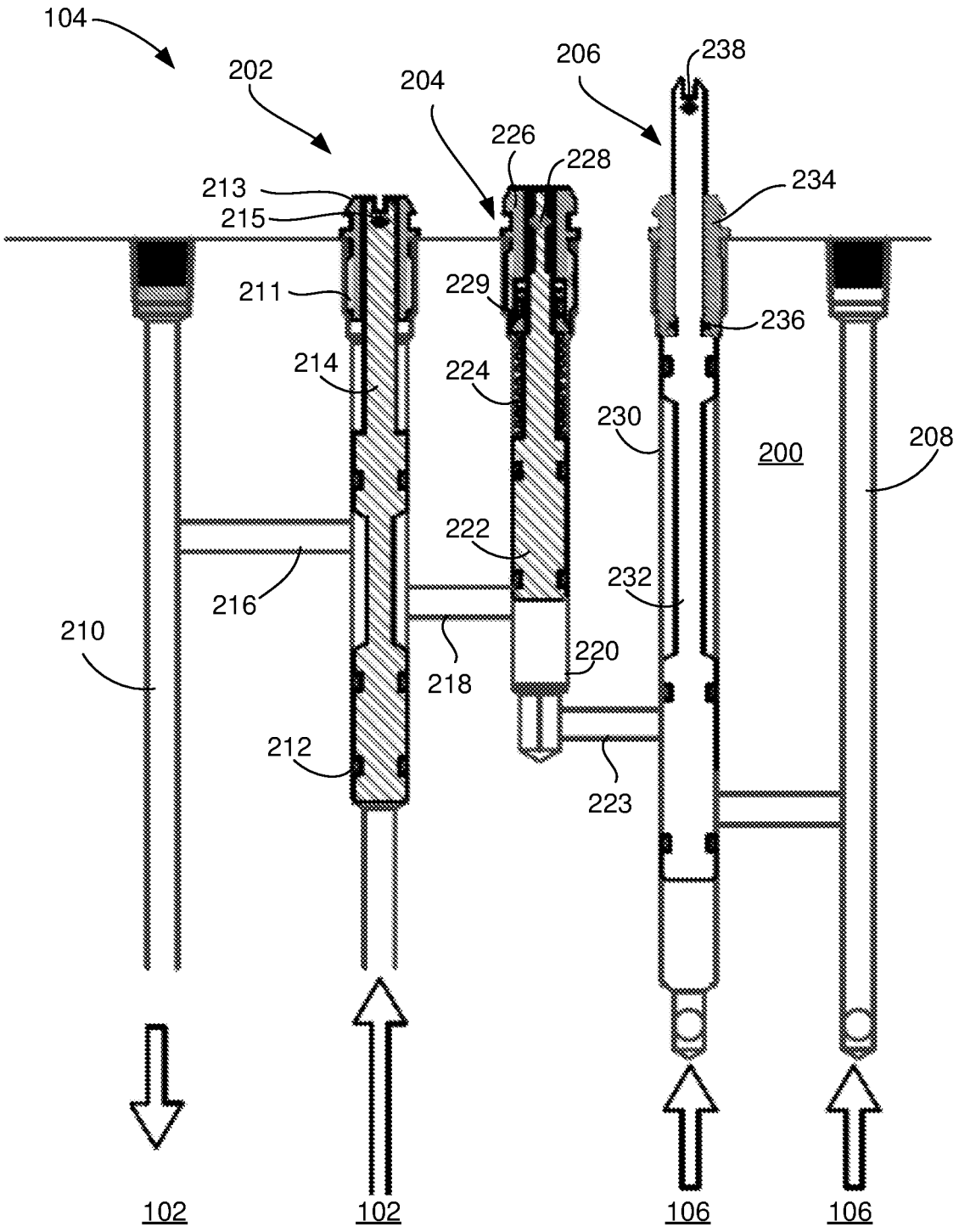
FIG. 6 illustrates a schematic view of the valve assembly in a contingency configuration, according to an embodiment.

To address this potential, the provision of the contingency valve 206 permits the valve assembly 104 to be actuated into a contingency configuration, as depicted in FIG. 6. The contingency valve 206 may be closed independently of the pressure in the inflatable element 102. Thus, as shown in FIG. 6, pressure in the tubular string 106 may apply on the contingency valve member 232. When the pressure in the tubular string 106 reaches a third pressure level, the restraint 234 may release (e.g., the shearable member 238 yields), permitting the contingency valve member 232 to stroke upwards to the closed position, thereby blocking fluid flow from the inlet 208 from reaching the opening valve 204. Further, the contingency valve 206 blocking fluid flow from the inlet 208 to the opening valve 204 may permit the opening valve 204 to move into its closed position and engage the lock 229, such that the valve assembly 104 is locked closed.

Figure 7:
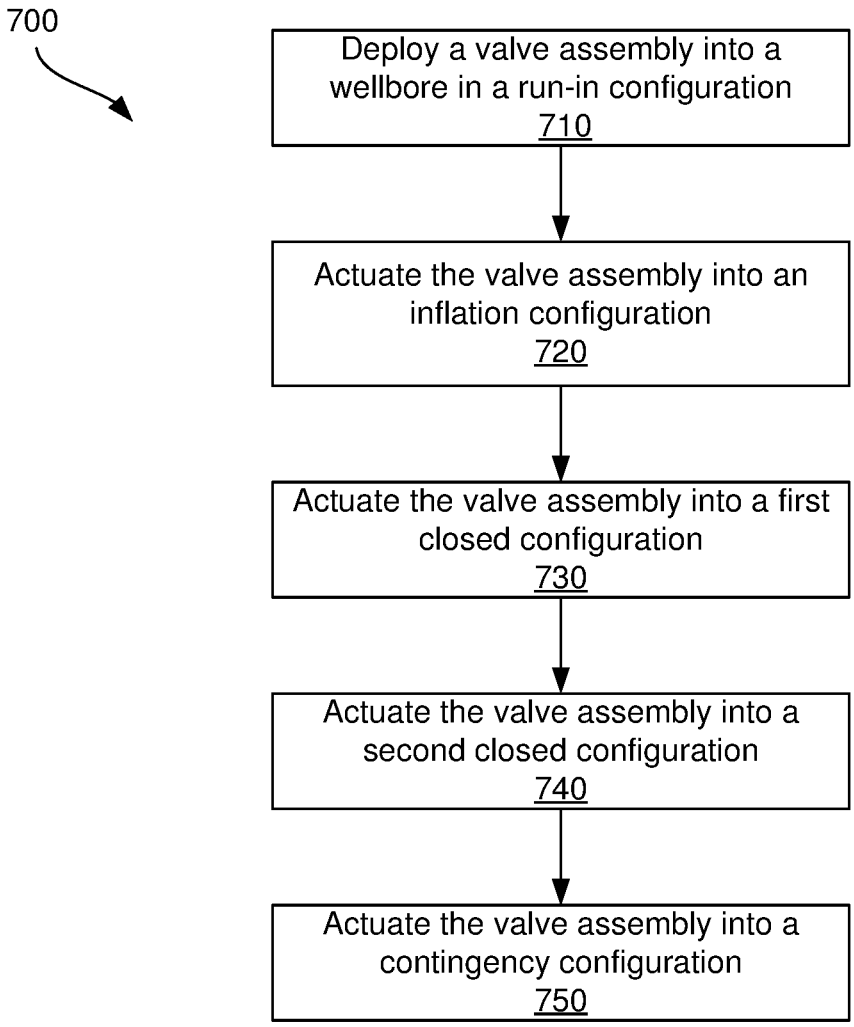
FIG. 7 illustrates a flowchart of a method for operating the inflatable packer, according to an embodiment.

FIG. 7 illustrates a flowchart of a method 700 for operating the inflatable packer 100, according to an embodiment. More particularly, the method 700 may be for controlling the valve assembly 104. An illustrative order of the method 700 is provided below; however, one or more steps of the method 700 may be performed in a different order, simultaneously, repeated, or omitted.

The method 700 may include deploying the valve assembly 104 into a wellbore in a run-in configuration, as at 710. In an embodiment, the inflatable packer 100 (e.g., the inflatable element 102, the valve assembly 104, and/or the tubular string 106) may be deployed simultaneously.

As described above, in the run-in configuration, the valve element 104 blocks the fluid from the tubular string 106 from reaching the inflatable element 102, thereby retaining the inflatable element 102 uninflated while being deployed in the wellbore. More particularly, one or more of the valve members 214, 222, 232 in the valve element 104 may block the fluid from the tubular string 106 from reaching the inflatable element 102. In the example shown in FIG. 2, the closing valve member 214 may be in the opening position, the opening valve member 222 may be in the closed position, and the contingency valve member 232 may be in the open position. Thus, the opening valve member 222 may block the fluid from the tubular string 106 from reaching the inflatable element 102.

Once the inflatable packer 100 (e.g., the valve assembly 104) reaches the desired location in the wellbore, the method 700 may also include actuating the valve assembly 104 from the run-in configuration to an inflation configuration, as at 720. Actuating the valve assembly 104 into the inflation configuration may include moving the opening valve member 222 from the closed position (e.g., vertically upward) to the open position. An example of this is shown in FIG. 3. The valve assembly 104 may be actuated into the inflation configuration in response to a pressure of the fluid in the tubular string 106 being increased to a first pressure level. In the inflation configuration, the valve assembly 104 permits fluid from the tubular string 106 to reach the inflatable element 102 and inflate the inflatable element 102.

The method 700 may also include actuating the valve assembly 104 from the inflation configuration to a first closed configuration, as at 730. Actuating the valve assembly 104 into the first closed configuration may include moving the closing valve member 214 from the open position (e.g., vertically upward) to the closed position. An example of this is shown in FIG. 4. The valve assembly 104 may be actuated into the first closed configuration in response to the pressure of the fluid in the inflatable element 102 and/or the tubular string 106 being increased to a second pressure level, which may represent that the inflatable element 102 has fully inflated. The second pressure level may be different (e.g., greater than) the first pressure level. In the first closed configuration, the valve assembly 104 (e.g., the closing valve member 214) blocks fluid flow from the tubular string 106 into the inflatable element 102.

The method 700 may also include actuating the valve assembly 104 from the first closed configuration to a second closed configuration, as at 740. Actuating the valve assembly 104 into the second closed configuration may include moving the opening valve member 222 from the open position (e.g., vertically downward) to the closed position. An example of this is shown in FIG. 5. The valve assembly 104 may be actuated into the second closed configuration in response to the pressure of the fluid in the tubular string 106 being decreased (e.g., from the first and/or second pressure level). In the second closed configuration, the valve assembly 104 (e.g., closing valve member 214 and/or the opening valve member 222) block fluid flow from the tubular string 106 into the inflatable element 102.

In at least some embodiments, the second pressure level may not be reached (e.g., because the inflatable element 102 or some other part of the packer 100 has ruptured). In this case, steps 730 and/or 740 may be bypassed, and the method 700 may instead include actuating the valve assembly 104 from the inflation configuration to a contingency configuration, as at 750. Actuating the valve assembly 104 into the contingency configuration may include moving the contingency valve member 232 from the open position (e.g., vertically upward) to the closed position. An example of this is shown in FIG. 6. The valve assembly 104 may be actuated into the contingency configuration in response to the pressure of the fluid in the tubular string 106 being varied to a third pressure level. The third pressure level may be greater than the first pressure level and greater than or less than the second pressure level. In the contingency configuration, the valve assembly 104 (e.g., the contingency valve member 232) blocks fluid flow from the tubular string 106 into the inflatable element 102, despite the inflatable element 102 not reaching the second pressure level.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A valve assembly for an inflatable packer, the valve assembly comprising:

an opening valve configured to actuate into an open position in response to a first pressure within a tubular string, so as to permit fluid flow from the tubular string, through the valve assembly, and into an inflatable packer element;

a closing valve configured to actuate into a closed position so as to prevent fluid flow from the tubular string, through the valve assembly, and into the inflatable packer element in response to a second pressure within the inflatable packer element; and a contingency valve configured to actuate into a closed position so as to prevent fluid flow from the tubular string, through the valve assembly, and into the inflatable packer element in response to a third pressure in the tubular string, wherein the contingency valve comprises a contingency valve member having a first plunger portion and a second plunger portion, wherein the first plunger portion comprises first and second seals, wherein the second plunger portion comprises a third seal, wherein the first and second seals are configured to be positioned such that they straddle a conduit from the tubular string to the contingency valve and/or from the contingency valve to the opening valve, which prevents fluid flow from the tubular string, through the valve assembly, and into the inflatable packer element.

2. The valve assembly of claim 1, wherein the contingency valve is also configured to actuate into the closed position in response to an inability to reach the second pressure within the inflatable packer element.

3. The valve assembly of claim 1, wherein the third pressure is greater than the first pressure and independent of a pressure in the inflatable packer element.

4. The valve assembly of claim 1, further comprising:

a restraint that restrains the closing valve in an open position, wherein the second pressure overcomes the restraint and drives the closing valve to the closed position; and a restraint that restrains the contingency valve in an open position, wherein the third pressure overcomes the restraint and drives the contingency valve to the closed position, and wherein the first and second pressures do not overcome the restraint.

5. The valve assembly of claim 1, wherein the opening valve is positioned between the closing valve and the contingency valve, such that the contingency valve in the closed position prevents fluid flow from an inlet of the valve assembly to the opening valve and to the closing valve.

6. The valve assembly of claim 1, wherein the valve assembly has a run-in configuration, and wherein, in the run-in configuration, the opening valve is in a closed position, the closing valve is in an open position, and the contingency valve is in an open position.

7. The valve assembly of claim 6, wherein the valve assembly has an inflation configuration, wherein the valve assembly actuates from the run-in configuration to the inflation configuration in response to the first pressure within the tubular string, and wherein, in the inflation configuration, the opening valve, the closing valve, and the contingency valve are in the respective open positions.

8. The valve assembly of claim 7, wherein the valve assembly has a first closed configuration, wherein the valve assembly actuates from the inflation configuration to the first closed configuration in response to the second pressure in the inflatable packer element, and wherein, in the first closed configuration, the closing valve is in the closed position, and the open and contingency valves remain in the respective open positions.

9. The valve assembly of claim 8, wherein the valve assembly has a second closed configuration, and wherein, in the second closed configuration, the opening valve is in the closed position, the closing valve remains in the closed position, and the contingency valve remains in the open position.

10. The valve assembly of claim 7, wherein the valve assembly has a contingency configuration in response to the second pressure not being reached, wherein the valve assembly actuates from the inflation configuration to the contingency configuration in response to the third pressure, and wherein, in the contingency configuration, the contingency valve is in the closed position where the first and second seals are positioned such that they straddle the conduit from the tubular string to the contingency valve and/or from the contingency valve to the opening valve, and the opening and closing valves remain in the respective open positions.

11. The valve assembly of claim 1, wherein the closing valve comprises a closing valve member having a first plunger portion and a second plunger portion, wherein the first plunger portion comprises first and second seals, wherein the second plunger portion comprises a third seal, wherein the first and second seals are configured to be positioned such that they straddle a conduit from the opening valve to the closing valve and/or from the closing valve to the inflatable packer element, which prevents fluid flow from the tubular string, through the valve assembly, and into the inflatable packer element.

12. An inflatable packer, comprising:

an inflatable packer element fluidly connected to a tubular string; and a valve assembly coupled to and positioned between the tubular string and the inflatable packer element, wherein the valve assembly comprises an opening valve, a closing valve, and a contingency valve, wherein the contingency valve comprises a contingency valve member having a first plunger portion and a second plunger portion, wherein the first plunger portion comprises first and second seals, wherein the second plunger portion comprises a third seal, and wherein the valve assembly comprises a plurality of configurations including:

a run-in configuration in which the opening valve is in a closed position, the closing valve is in an open position, and the contingency valve is in an open position;

an inflation configuration, wherein the valve assembly is configured to actuate from the run-in configuration to the inflation configuration in response to a first pressure within the tubular string, and wherein, in the inflation configuration, the opening valve is in an open position to permit fluid flow from the tubular string, through the valve assembly, and into the inflatable packer element, and the closing and contingency valves remain in the respective open positions;

a first closed configuration, wherein the valve assembly is configured to actuate from the inflation configuration to the first closed configuration in response to a second pressure in the inflatable packer element, and wherein, in the first closed configuration, the closing valve is in a closed position to prevent fluid flow from the tubular string, through the valve assembly, and into the inflatable packer element, and the open and contingency valves remain in the respective open positions; and a contingency configuration in response to the second pressure not being reached, wherein the valve assembly is configured to actuate from the inflation configuration to the contingency configuration in response to a third pressure in the tubular string, wherein, in the contingency configuration, the contingency valve is in a closed position where the first and second seals are positioned such that they straddle a conduit from the tubular string to the contingency valve and/or from the contingency valve to the opening valve to prevent fluid flow from the tubular string, through the valve assembly, and into the inflatable packer element, and the opening and closing valves remain in the respective open positions, and wherein the third pressure is greater than the first pressure and independent of a pressure in the inflatable packer element.

13. The inflatable packer of claim 12, wherein the valve assembly further comprises a second closed configuration, and wherein, in the second closed configuration, the opening valve is in the closed position, the closing valve remains in the closed position, and the contingency valve remains in the open position.

14. The inflatable packer of claim 12, wherein the valve assembly further comprises a restraint that restrains the closing valve in the open position, and wherein the second pressure overcomes the restraint and drives the closing valve to the closed position.

15. The inflatable packer of claim 12, wherein the valve assembly further comprises a restraint that restrains the contingency valve in the open position, wherein the third pressure overcomes the restraint and drives the contingency valve to the closed position, and wherein the first and second pressures do not overcome the restraint.

16. The inflatable packer of claim 12, wherein the opening valve is positioned between the closing valve and the contingency valve, such that the contingency valve in the closed position prevents fluid flow from an inlet of the valve assembly to the opening valve and to the closing valve.

17. A method for operating an inflatable packer, the method comprising:

deploying a valve assembly into a wellbore in a run-in configuration, wherein the valve assembly comprises an opening valve, a closing valve, and a contingency valve, and wherein, in the run-in configuration, the opening valve is in a closed position, the closing valve is in an open position, and the contingency valve is in an open position;

increasing a pressure within a tubular string to a first pressure level, which actuates the valve assembly from the run-in configuration into an inflation configuration, wherein the opening valve drives into an open position when actuating into the inflation configuration so as to permit fluid flow from the tubular string, through the valve assembly, and into an inflatable packer element, while the closing and contingency valves remain in the respective open positions; and increasing a pressure within the tubular string to a third pressure level in response to not being able to reach a second pressure level in the inflatable packer element, wherein increasing the pressure within the tubular string to the third pressure level actuates the valve assembly from the run-in configuration into a contingency configuration, wherein the contingency valve comprises a contingency valve member having a first plunger portion and a second plunger portion, wherein the first plunger portion comprises first and second seals, wherein the second plunger portion comprises a third seal, wherein the contingency valve drives into a closed position when actuating into the contingency configuration where the first and second seals are positioned such that they straddle a conduit from the tubular string to the contingency valve and/or from the contingency valve to the opening valve to prevent fluid flow from the tubular string, through the valve assembly, and into the inflatable packer element, while the opening and closing valves remain in the respective open positions.

18. The method of claim 17, wherein the second pressure level is not able to be reached due to a leak in the inflatable packer.

19. The method of claim 17, wherein the second pressure level indicates that the inflatable packer element is fully inflated.

20. The method of claim 17, wherein the third pressure level is greater than the first pressure level and less than the second pressure level.

21. The method of claim 20, wherein the third pressure level is independent of a pressure in the inflatable packer element.

* * * * *